United States Patent [19]

Kleineisel et al.

[11] 4,115,033

[45] Sep. 19, 1978

[54] CONTROL DEVICE FOR A HYDRAULIC SYSTEM HAVING AT LEAST TWO PUMPS

[75] Inventors: Gustav Kleineisel, Mainaschaff; Dietrich Kuchenbecker, Aschaffenburg; Gerd Ahrens, Laufach, all of Germany

[73] Assignee: Linde Aktiengesellschaft, Wiesbaden, Germany

[21] Appl. No.: 762,173

[22] Filed: Jan. 24, 1977

[30] Foreign Application Priority Data

Jan. 30, 1976 [DE] Fed. Rep. of Germany ..... 2603563

[51] Int. Cl.[2] ..... F04B 49/00

[52] U.S. Cl. ..... 417/216; 60/428; 60/447

[58] Field of Search ..... 417/216, 218–222; 60/428, 445, 447, 449, 452

[56] References Cited

U.S. PATENT DOCUMENTS

| | | | |
|---|---|---|---|
| 3,625,637 | 12/1971 | Kiwalle et al. | 417/218 |
| 3,841,795 | 10/1974 | Ferre et al. | 417/216 |
| 3,935,706 | 2/1976 | Stevens | 417/218 X |
| 3,963,378 | 6/1976 | McMillan | 417/216 |

FOREIGN PATENT DOCUMENTS

| | | | |
|---|---|---|---|
| 2,363,480 | 6/1975 | Fed. Rep. of Germany | 417/221 |
| 2,502,488 | 7/1975 | Fed. Rep. of Germany | 60/452 |
| 1,198,624 | 7/1970 | United Kingdom | 417/222 |

*Primary Examiner*—Carlton R. Croyle
*Assistant Examiner*—Edward Look
*Attorney, Agent, or Firm*—Karl F. Ross

[57] ABSTRACT

A hydraulic system having at least two pumps including a variable-displacement pump and a constant-displacement pump, both driven from a common prime mover, includes a control-pressure pump operated by the shaft of the prime mover and operating with its input a valve which controls the pressure of a control piston acting upon a spring which bears upon the control member in a direction opposite to its setting piston. A cylinder of the setting piston is connected to the output of the adjustable-displacement pump.

11 Claims, 3 Drawing Figures

CONTROL DEVICE FOR A HYDRAULIC SYSTEM HAVING AT LEAST TWO PUMPS

FIELD OF THE INVENTION

The present invention relates to a control device for a hydraulic aggregate or system comprising two hydrostatic pumps, e.g. axial-piston pumps, at least one of which has a variable displacement per revolution while at least another has a constant displacement per revolution, the pumps being connected to separate hydraulic networks.

BACKGROUND OF THE INVENTION

Hydraulic aggregates for the powering of heavy machinery have a prime mover, such as an internal combustion engine, whose output shaft drives a plurality of pumps, including at least one variable-displacement pump and at least one constant-displacement pump, have been provided heretofore as described, for example, in *HIGHPRESSURE HYDRAULICS ON EUROPEAN EXCAVATORS,* by Hans-Dieter KNOLKER, published by Linde AG, Werksgruppe Güldner Aschaffenburg, Germany, (FIG. 13 and page 6).

Such systems do not respond adequately to the control arrangements which have hitherto been provided and, more particularly, do not respond effectively to drops in the output speed of the prime mover or energy source.

OBJECTS OF THE INVENTION

It is the principal object of the present invention to provide a control device for systems of the aforedescribed type and particularly for pump aggregates or hydraulic systems for heavy machinery having one or more variable-displacement pumps and one or more constant-displacement pumps.

Another object of the invention is to provide an improved control device for the cumulative power control (additive power control) of hydraulic aggregates having a plurality of variable-displacement pumps in addition to a constant-displacement pump, all driven by the same prime mover.

It is also an object of the invention to improve the response speed of a control system of the aforedescribed type for a hydraulic aggregate which is sensitive to drops in the output velocity of the prime mover and, more specifically, to overloading of the hydraulic networks.

SUMMARY OF THE INVENTION

These objects are attained, in accordance with the present invention, in a control system for a hydraulic arrangement or aggregate which comprises a variable-displacement pump and a constant-displacement pump, both driven by the output shaft of a prime mover and connected to respective load networks. The variable-displacement pump has a setting piston which can act against a spring and can be shiftable in a setting cylinder whose pressure is effective against the spring force to adjust the position of the control member of the variable-displacement pump. According to the invention, this cylinder is connected directly to the output side of the variable-displacement pump while the spring force applied to the control member is varied by means of a control piston received in a control cylinder which can be supplied with hydraulic fluid from a control-pressure pump connected to the output shaft of the energy source or prime mover. According to a feature of the invention, a valve responsive to the output of the control-pressure pump is provided between the latter and the control cylinder to adjust the pressure in the latter so that, upon overloading of the prime mover or source, the spring force described above is varied to shift the variable-displacement pump to a lower output per revolution, thereby overcoming the effect of overloading. The control-pressure pump has, of course, an output which is a function of the speed of the shaft.

According to another feature of the invention, the output of the control-pressure pump is provided with a throttle and the opposite sides of the valve are connected across the throttle. Furthermore, the control piston may be provided in parallel with the spring in its action upon the control member of the variable-displacement pump or can bear upon one side of the spring, while the other side of the spring acts upon the control member.

The control piston can be, in the first case, shiftable in a housing which is provided with the control cylinder and against which the spring is seated. The control piston can be integral with or can act upon a support plate against which the other side of the spring bears. Preferably the piston is in force-transmitting relationship with the aforementioned plate.

Alternatively, the piston can act as one of the seats for the spring, the other seat being formed by the aforementioned member.

The speed-responsive valve can be connected across the throttle in the output line of the control-pressure pump and the throttle may be adjustable with its adjusting element connected by the setting element (accelerator member) of the prime mover which can be an internal combustion engine.

According to still another feature of the invention, two such variable-displacement pumps can be provided, the control members of these pumps being connected together by a coupling member, e.g. a rod, which can act against the aforementioned spring. In this case both setting pistons are effective upon the control member and a cumulative load control (additive load control) is provided.

Furthermore, the control member itself may be selectively displaceable, e.g. means can be provided to act upon the coupling member apart from the aforementioned control piston and spring, to set the displacements of the pumps.

According to still another feature of the invention, the control piston can act against an abutment which itself can be selectively adjustable for reasons to be described in greater detail below.

While the control system of the present invention, which responds to overloading of the internal combustion engine or other prime mover, is of the cumulative-power or cumulative-load control type, as soon as the speed of the primary energy source because of overloading is diminished, the valve and control-pressure pump cause the spring to be less effective and hence permit the setting pistons, whose cylinders are pressurized directly from the output side of the variable-displacement pumps, to shift the respective control members into lower outputs per revolution.

Surprisingly, only the adjustable or variable-displacement pumps need be connected to the control, the system being effective nevertheless to regulate a system which includes one or more constant-output pumps. The response is rapid and precise.

It is possible with the system of the present invention to operate the primary energy source, usually an internal combustion engine, at maximum output without the danger of overloading the primary energy source or causing stalling thereof in this case, the speed responsive control is superimposed upon the pressure responsive control.

An earlier system which is incapable of responding as effectively as the present system can be found, for example, in U.S. Pat. No. 3,841,795. The significant differences between the present system and the system of this patent are the following:

The swingable pump-setting members of each variable-displacement pump are controlled directly in response to the output pressure of the respective pump via a setting piston whose cylinder is supplied from the network connected to the output side of the pump, the control members acting against a spring (see German Pat. No. 1,188,891).

Only the output pressures of the variable-displacement pumps are effective upon the controllable member (i.e. the constant-displacement pumps are not effective in this respect).

The spring against which the setting pistons act have controllable force which is regulated by a control piston common to all of the variable-displacement pumps.

The position of the control piston is determined by a pressure responsive valve which is connected to the output of the control pressure pump and preferably across a throttle connected to the output of the latter.

In the system of the present invention, moreover, the outputs of the working pumps are not used as control pressures except for the direct action on the respective setting pistons and, moreover, the output of the control pressure pump is not applied directly to these pistons. By comparison with prior art arrangements, the control system of the present invention is greatly simplified, uses much fewer control members and fewer valves, and is far more rapid in response than the prior art systems.

The pumps can be axial-piston pumps in which the tilt of the control plate is regulated by the setting pistons, these plates being constituted as the control members.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
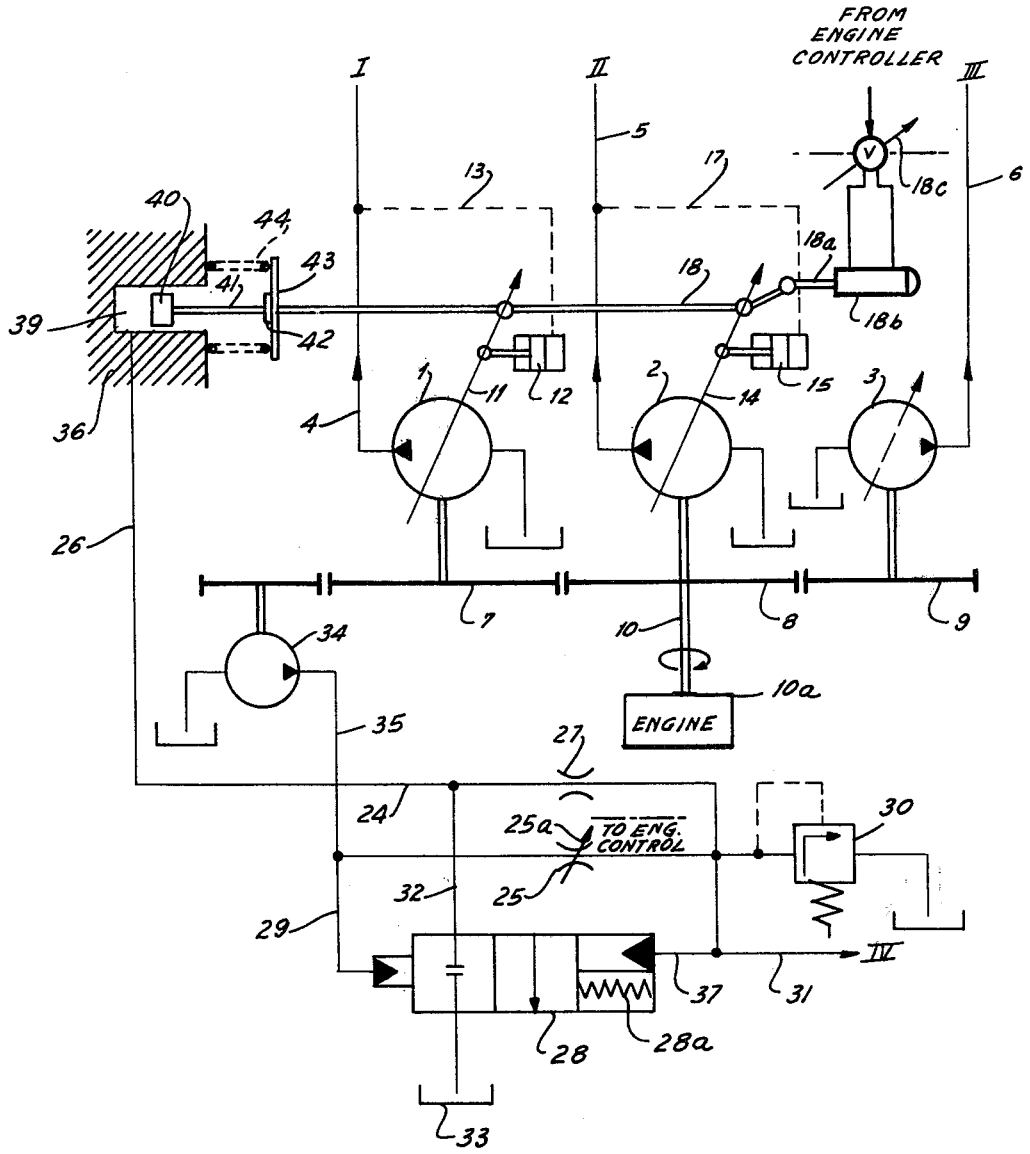
FIG. 1 is a flow diagram of a control arrangment in which the control pistons are connected in parallel with the spring.

As can be seen in FIG. 1, the pumps 1, 2 and 3 are the working pumps of the system. The pump 1 is connected via its high pressure line 4 to the hydraulic circuit I, the pump 2 is connected via its high pressure side and discharge line 5 to the hydraulic circuit II and the pump 3 is connected via its feed line 6 to the hydraulic circuit III.

The drive shafts of the pumps 1, 2 and 3 are connected together via the meshing gears 7, 8 and 9 which are driven from a common prime mover 10*a* not shown in detail via the shaft 10. The prime mover or primary energy source can be an internal combustion engine.

Pump 1 and 2 are of the adjustable type, e.g. axial-piston pumps whose control plates can be swung to determine the displacement per revolution of the respective pumps. The control member, e.g. control plate, 11 of pump 1 is connected to a setting piston 12 which is displaceable in a respective hydraulic cylinder whose working chamber is disposed at the right hand of the piston 12 and communicates via the control duct 13 with the supply line 4 of this pump.

In an identical manner, the control member, i.e. control plate, 14 of the pump 2 is provided with setting piston 15 whose setting cylinder 16 communicates via the duct 17 with the supply line 5 at the discharge side of the pump 2. When hydraulic fluid is supplied to the cylinder 16 or to the cylinder of piston 12, the piston 15 and 12 are shifted to the left to swing the control member of the respective pumps 1, 2 to reduce the displacement per unit revolution of the respective pump.

The working pump 3 is a constant-displacement pump, i.e. a pump whose displacement per unit volume cannot be varied. Of course, this pump also may be a variable-displacement pump whose control member is fixedly positioned or is adjustable only by some auxiliary means not illustrated.

The control members 11 and 14, respectively, and the setting pistons 12 and 15 are interconnected via a rod 18 which is provided with a plate 43 against which a load-control spring 44 can bear. The spring 44 also acts against a housing 38.

A bore in the housing 36 forms a cylinder chamber 39 slidably receiving a piston 40 which is connected via the piston rod 41 with the support surface 42 of the plate 43. The rod 41 can thus withdraw from the surface 42 or continuously act thereon. The piston 40 can, in accordance with another embodiment of the invention, be formed as a massive piston whose ball-shaped head at its free end can rest against a complementary spherical surface on the support plate 43.

The shaft 10 also drives a control pressure pump 34 via another gear wheel meshing with one of the gear wheels 7-9, the output side of this pump being provided with a pressure line 35 having a throttle 25 therein. Downstream of the throttle, there is connected a further line 24, provided with another throttle 27 and communicating with the cylinder chamber 39 via a line 26. A branch line 37 is also connected to the output side of the pump 34 downstream of the throttle 25, the branch line 37 communicating with one side of a hydraulically controllable valve 28. The other side of this valve 28 is connected via lines 29 to the duct 35 ahead of (upstream of) the throttle 25, via line 29.

In parallel to the hydraulic fluid supplied by line 37 and acting upon the slider surface of the valve 28, there is provided a spring 28*a*.

Line 24 is, downstream of the throttle 25, connected to a pressure-relief valve 30 which, upon the development of an excess pressure, bleeds hydraulic fluid into a reservoir. Such a pressure relief valve can also be provided directly on line 35 ahead of the throttle 25. In addition, a duct 31 can be connected to line 24 upstream of or downstream of the throttle 25, this line 31 running to a low pressure load as represented at IV, via a respective hydraulic network, as long as this load or the demand thereof does not cause significant variations in the back pressure. Thus the load of network IV can be hydraulic fluid consumer requiring only a small flow rate.

From the line 24, there is branched a second line 32 which is connected to one port of the valve 28. Consequently, if the throttle 25 develops a relatively high pressure drop, the valve 28 will block the line 32 (i.e. the position shown in FIG. 1). If this pressure drop is lower than a predetermined value, the spring of valve 28 will become effective so that the line 32 is connected to a pressureless reservoir 33, thereby draining control fluid from line 24 and line 26 and hence from the cylinder 29. The throttle 27 prevents such rapid draining of the control fluid that line 26 will rebuild its original pressure.

The operation of the system of FIG. 1 is summarized as follows:

The output pressure in line 4 and the output pressure in line 5 operate via the parts 11, 12, 14, 15, 16, 13, 17, 18, 44 in the manner of cumulative load regulator or controller (additive load controller). The pressure in each of the two lines 4 and 5 acts upon the respective setting piston 12, 15 and the total force applied to these pistons also is applied via a connecting rod 18 to the spring 44. The force of the piston 40 acts in parallel upon the spring 44 and upon the plate 43 against which this spring bears. As long as the pressure in line 26 remains constant, the force exerted by the piston 20 additionally upon the spring 44 remains constant. With increasing force in the rod 18, the spring 44 is compressed until the rate of force upon the spring 44 together with the force of the control piston 40 is equal to the force applied via rod 18 and a force balance is created. The two pumps 1 and 2 are thus coupled together and are simultaneously adjusted such that the sum of the loads supplied by the pumps 1 and 2 does not exceed a predetermined value.

This produces a satisfactory load control as long as the demand or load at the pump 3 does not exceed a predetermined value. Because of the interconnection of the pumps, the pumps 3 supplies a high pressure except in the case in which lines or networks I and II are relatively low pressures. Only in this case are the networks I and II operated at less than full demand.

Since the control pressure pump 34 is a constant-displacement pump, the pressure generated thereby and its displacement is proportional to the rotary speed of the drive shaft 10. Thus, at the throttle 25, a pressure drop is developed which is a function of the rotary speed of the drive shaft 10. As long as this pressure drop exceeds a predetermined value, the line 32 remains blocked. Should the speed of the shaft 10 fall as a result of overloading of the primary energy source, i.e. the internal combustion engine, the displacement of the control pressure pump 34 likewise drops and the pressure drop across the throttle 25 is thereby reduced. The valve 28 opens the connection between line 32 and the pressureless reservoir 33. The pressure in line 26 is thereby reduced and the piston 40 is displaced to the left or exerts a reduced pressure upon the plate 33 so that a displacement of the rod 18 to the left and a commensurate displacement of the setting pistons 12 and 15 to the left is permitted. The control members 11 and 14 of the pumps 1 and 2 thus swing into positions of reduced displacement per unit volume. The full capacity of the primary energy source or engine thus becomes available again and the output at pump 3 can increase.

Figure 2:
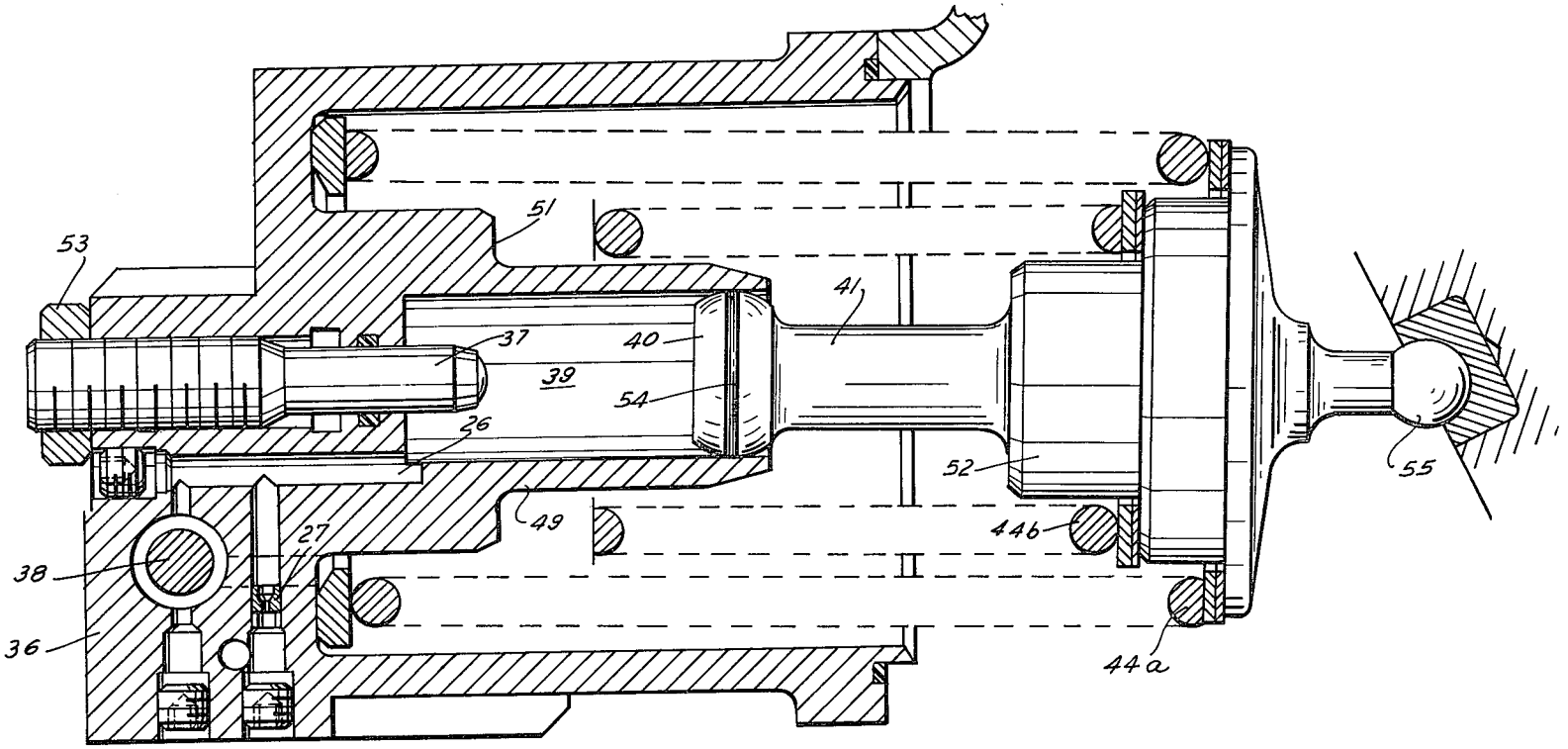
FIG. 2 is an axial cross section through the control piston and spring arrangement according to the invention and for the system of FIG. 1.

FIG. 2 illustrates a preferred construction of the assembly 38 etc. described only briefly in the schematic diagram of FIG. 1. In this embodiment, the piston 40 is provided with a piston rod 41 which carries a support plate 54 forming a single unit with the piston rod 41 and the piston 40. The load controller spring 44 is here constituted as two coaxial springs **44*a* and 44*b* of which the spring 44*b* comes into play only after its left hand end engages an abutment or shoulder 51 of the housing 36. This can occur only after the spring 44*a*** has been compressed to a certain extent. This spring construction provides a total spring characteristic with a point of inflection or break in accordance with well-known spring principles.

On the opposite side of the plate 52, there is provided a ball head 55 which is rigid with the abutment 52 and engages a ball-shaped socket in a yoke which can connect the swingable control members of the pumps 1 and 2 together. In this case, the rod 18 as the coupling member can be eliminated. The ball head 55 can describe an arcuate movement about the axis of the yoke so that it is advantageous to form the piston 40 as a sperical piston which can be sealed by the piston ring 54.

The cylinder 39 can be formed in a boss 49 of the housing 36 so that it can simultaneously form a guide for the inner spring **44*b*. The bolt 37 can be threaded into the housing 36 to form an adjustable stop for the extreme lefthand position of the piston 40. A counternut 53 threaded onto the bolt 37 is designed to lock it in place in its adjusted position. The slider 38 of the valve 28 can also be disposed in the housing 36 as has been illustrated in FIG. 2. To this end, the housing 36 is provided with bores communicating with the control-pressure pump 34, the throttles and with the line 26 which connects the valve 28 with the bore 39**.

Figure 3:
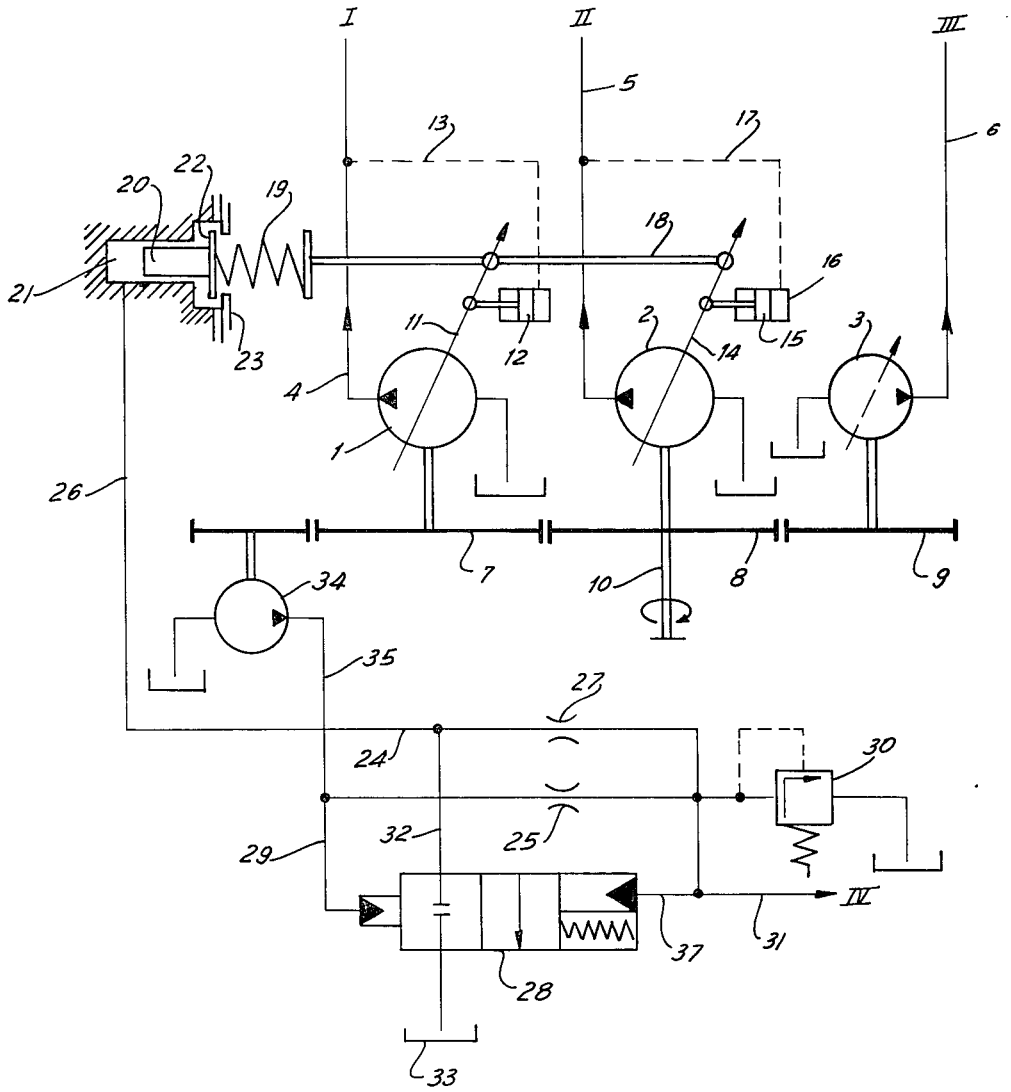
FIG. 3 is a flow diagram illustrating another embodiment of the invention in which the spring is supported against the control piston.

In the embodiment illustrated in FIG. 3, the control members 11 and 14 and the setting pistons 12 and 15 of the pumps 1 and 2 are also shown to be interconnected by a rod 18 which, however, acts upon one side of the load-control spring 19 the other side of which acts directly upon a control piston 20 which is received in a cylinder 21. The remainder of the circuit is constituted as described in FIG. 1, the cylinder 21 being supplied by the line 26.

The control piston 20 is provided with an abutment plate 22 limiting the displacement of the piston 20 to the left by the spring 19.

As long as the plate 22 is held by the pressure in cylinder 21 against an abutment 23, the lefthand side of spring 19 can be considered to have a fixed seat. When, however, the valve 28 connects the line 32 to the reservoir 33, the pressure in line 26 is reduced, the piston 20 shifts to the left and enables the rod 18 to move similarly so that the control members 11 and 14 follow the movement of the rod and reduce the output per unit revolution of the pumps 1 and 2.

When it is desired manually or otherwise to selectively reduce the outputs of the pumps 1 and 2 and hence the supply of fluid to networks I and II, the rod 18 can be displaced to the left to increase the pressure on spring 19. A further piston **18*a* (servopiston or setting piston) in a respective cylinder 18*b* can be provided for this purpose, the cylinder being hydraulically supplied under manual or other control as applied at 18*c*** from the accelerator of the engine.

To permit the system to be self-adjusting for various settings of the prime mover connected to the shaft 10, the abutment 23 can be made movable relative to the cylinder 21, preferably in dependence upon the setting of the internal combustion engine or other prime movers.

Another means of adjusting the response of the system to the different settings of the prime mover is to make the throttle 25 adjustable and to connect the adjusting member 25*a* of this throttle with the control element of the prime mover.

Through the recession of the control pistons 20 and 40 to the left, at each drop in the rotary speed of the primary energy source because of overloading, the power increase adjusts the variable-capacity pump. Since a drop in the speed of the primary energy source is independent of which one or more of the hydraulic networks I, II or III sustains a higher pressure than is desired, the control system remains effective although the constant-output pump is not connected to the cumulative-power controller 12, 15, 13, 17, 18 and 19 or 44. Obviously the control system will remain effective even if the pump 3 is an adjustable output pump. The pump assembly can have more than two pumps and more than a single nonadjustable pump corresponding to the pump 3.

We claim:

1. A control device for a hydraulic system comprising at least one first pump having a variable output per revolution as determined by the position of a control member and connected to a first hydraulic network, at least one second pump having a predetermined output per revolution, an energy source having an output shaft connected to said pumps for driving same, and a setting piston shiftable in a respective cylinder and operatively connected to said member for varying the displacement per revolution of said first pump, said control device comprising, in combination:

a control line connecting the output side of said first pump with said cylinder;

a control-pressure pump connected to said shaft and having an output determined by the speed of said shaft;

a spring action on said member in a direction opposite to that at which pressure in said cylinder acts upon said member;

a control piston acting upon a seat of said spring for varying the degree to which said spring tends to allow displacement of said control member;

a control cylinder slidably receiving said piston;

a control valve responsive to the output of said control pressure pump; and means for applying the output of said control pressure pump as controlled by said valve to said control cylinder.

2. The device defined in claim 1 wherein said control piston acts upon said member in parallel with said spring.

3. The control device defined in claim 2 wherein said control cylinder is formed in a housing and said spring bears at one side against said housing and at the opposite side against a plate connected to said member, said control piston acting upon said plate.

4. The device defined in claim 3 wherein said control piston is in force-transmitting relationship with said plate.

5. The device defined in claim 1 wherein said control piston engages one end of said spring, the other end of said spring bearing against said member.

6. The device defined in claim 5, further comprising an abutment for said control piston.

7. The device defined in claim 6, wherein said abutment is selectively adjustable.

8. The device defined in claim 1, further comprising a first throttle connected between said control pressure pump and said cylinder, and a second throttle connected across the actuators of said valve.

9. The device defined in claim 8 wherein said throttle is adjustable in response to the settings of said source.

10. The device defined in claim 1 wherein a plurality of such first pumps are provided and the respective control members of said first pumps are interconnected by a coupling acting upon said spring.

11. The device defined in claim 10, further comprising means for selectively applying a controllable force to said coupling.

* * * * *